US008863670B2

(12) United States Patent
Jackson

(10) Patent No.: US 8,863,670 B2
(45) Date of Patent: Oct. 21, 2014

(54) RAIL MOVER WITH INDEPENDENTLY PIVOTING WHEEL ASSEMBLIES

(75) Inventor: Eldon Don Jackson, Lee's Summit, MO (US)

(73) Assignee: Nordco Inc., Oak Creek, WI (US)

( * ) Notice: Subject to any disclaimer, the term of this patent is extended or adjusted under 35 U.S.C. 154(b) by 196 days.

(21) Appl. No.: 13/473,217

(22) Filed: May 16, 2012

(65) Prior Publication Data

US 2013/0305956 A1 Nov. 21, 2013

(51) Int. Cl.
*B61C 11/00* (2006.01)
*B61C 13/00* (2006.01)

(52) U.S. Cl.
CPC ..... *B61C 13/00* (2013.01)
USPC ..... 105/72.2; 105/215.1; 105/215.2

(58) Field of Classification Search
USPC ..... 105/72.2, 215.1, 215.2
See application file for complete search history.

(56) References Cited

U.S. PATENT DOCUMENTS 3,019,742 A * 2/1962 Kershaw ..... 105/72.2
4,534,297 A * 8/1985 Johnson, Sr. ..... 105/90.2
4,537,137 A * 8/1985 White, Jr. ..... 105/72.2
5,103,740 A * 4/1992 Masse ..... 105/72.2
5,802,980 A * 9/1998 Hofmiller ..... 105/72.2
5,868,078 A * 2/1999 Madison ..... 105/72.2
6,352,035 B1 * 3/2002 Kashiwase et al. ..... 105/72.2
6,477,963 B1 * 11/2002 Weule et al. ..... 104/243
6,763,767 B2 * 7/2004 Jackson et al. ..... 105/72.2
6,988,451 B2 * 1/2006 Marcotte et al. ..... 105/215.1
8,353,248 B2 * 1/2013 Kurahashi et al. ..... 105/215.2
8,356,559 B2 * 1/2013 Kurahashi et al. ..... 105/215.2
8,381,660 B2 * 2/2013 Kurahashi et al. ..... 105/215.2
8,505,465 B2 * 8/2013 Elizondo ..... 105/168
8,561,547 B2 * 10/2013 Shiroyama et al. ..... 105/215.2
2004/0123768 A1 * 7/2004 Marcotte et al. ..... 105/215.1
2011/0265683 A1 * 11/2011 Kurahashi et al. ..... 105/215.2
2012/0031298 A1 * 2/2012 Kurahashi et al. ..... 105/215.2
2012/0103228 A1 * 5/2012 Elizondo ..... 105/141
2013/0305956 A1 * 11/2013 Jackson ..... 105/72.2

* cited by examiner

*Primary Examiner* — Jason C Smith
(74) *Attorney, Agent, or Firm* — Greer, Burns & Crain, Ltd.

(57) ABSTRACT

A rail draft vehicle for moving railcars along a pair of rails includes a frame having a front end and a rear end. The vehicle also has a front wheel assembly associated with the front end of the frame as well as a rear wheel assembly associated with the rear end of the frame. Each of the wheel assemblies includes an axle housing with a differential and a pair of road wheels connected for rotation relative to the axle housing. Each wheel assembly pivots as a unit relative to the frame about a vertical axis. The vehicle also includes an engine attached to the frame. In addition, a power train powered by the engine drives each of the wheel assemblies and is connected to each wheel assembly.

19 Claims, 7 Drawing Sheets

RAIL MOVER WITH INDEPENDENTLY PIVOTING WHEEL ASSEMBLIES

BACKGROUND

The present invention generally relates to railway draft vehicles used to move railcars along railroad track, also referred to as rail movers or rail car movers. More specifically, the present invention relates to such a draft vehicle that has an improved steering and propulsion control over front and rear wheel assemblies.

Rail draft vehicles are typically found in rail yards or industrial sites for moving single or groups of rail cars to form trains. These vehicles feature rubber tired wheels for contacting the rails, since it has been found that such wheels have a higher coefficient of friction with the rails than steel wheels and are thus able to develop increased pulling power compared to steel wheeled vehicles. Since railroad track conforms to the underlying terrain, track typically includes inclines, banked turns and hills, all of which need to be accommodated by rail draft vehicles. Steering of such vehicles is achieved using independently pivoting front and rear wheel assemblies. To effect a turn, the front wheels pivot in one direction, and the rear wheels pivot in the opposite direction. However, it can be difficult to maintain the road wheels on the rails. Thus, there exists a need for a rail draft vehicle that relatively consistently maintains the road wheels on the rails.

Another drawback of conventional rail draft vehicles is that the wheels are configured for being steered in the same manner as a conventional truck. This means that any universal joints are located at a conventional location at the ends of the front or rear axle next to each of the road wheels. Thus, a need exists for a rail mover with a relatively simpler power transmission system.

Conventional units of this type employ separate hydrostatic motors for independently driving the front and rear axles. Representative units are described in U.S. Pat. No. 3,434,432. These units are relatively expensive to build and maintain.

Another drawback of conventional rail draft vehicles is that there are heavy loads on the front and rear axles, which are independently powered as described above. Accordingly, the respective joints, bearings, and other drive system components experience significant wear, and in some cases, failure. Increased wear is particularly present when the vehicle negotiates a turn, because the connection between the wheel axle and the transmission is offset. To address this, conventional draft vehicles use U-joint connections in the drive trains. However, this type of connection results in fluctuations in rotational velocity. Drawbacks of these systems include accelerated wear on the vehicle components. As such, there is a need for an improved drive system for rail car movers.

SUMMARY

The above-identified needs are met or exceeded by the present improved rail draft vehicle, which features a frame having a pair of wheel assemblies, each having a fixed axle housing with a differential and a pair of road wheels. Each wheel assembly independently pivots as a unit, about a vertical axis, relative to the frame. The rigidity of the fixed axles provides a more powerful and structurally sound draft vehicle, which outperforms conventional draft vehicles. The present structure also reduces required maintenance, the chance for premature failure, and the number of suspension components such as king-pins and A-arms.

Additionally, the above-identified needs are met by a draft vehicle featuring a transmission that simultaneously drives both a front drive shaft and a rear drive shaft so that the front and rear wheels are simultaneously powered. Constant velocity joints are preferably provided to each drive shaft. For instance, a constant velocity joint connects the front drive shaft to a front wheel assembly at a front differential, and another constant velocity joint connects a rear drive shaft to a differential of a rear wheel assembly. Compared to conventional hydrostatic power transmission systems, using a constant velocity joint greatly increases the efficiency of the transmission to the pivoting wheel assemblies as they move for steering purposes. Such joints also reduce the operational stresses on the power train components of the vehicle, thus reducing vehicle maintenance costs.

More specifically, a rail draft vehicle is provided for moving railcars along a pair of rails and includes a frame having a front end and a rear end, a front wheel assembly associated with the front end of the frame, and a rear wheel assembly associated with the rear end of the frame. Each wheel assembly includes an axle housing and a pair of road wheels connected for rotation relative to the axle housing, and each wheel assembly pivots as a unit relative to the frame about a vertical axis. The vehicle also includes an engine associated with the frame and a power train powered by the engine for driving each of the wheel assemblies.

In another embodiment, a rail draft vehicle is provided for moving railcars along a pair of rails and includes a transmission, a front drive shaft connected to the transmission at one end and connected by a front constant velocity joint to a front differential at the other end. The front differential drives a pair of front wheels. Also, a rear drive shaft is connected to the transmission at one end and is connected by a rear constant velocity joint to a rear differential at the other end. The rear differential drives a pair of rear wheels.

In yet another embodiment, a rail draft vehicle is provided for moving railcars along a pair of rails, the vehicle including a frame having a front end and a rear end, a front wheel assembly associated with the front end of the frame and a rear wheel assembly associated with the rear end of the frame. Each wheel assembly has a differential and a pair of road wheels joined by an axle, and each wheel assembly pivots as a unit relative to the frame about a vertical axis. The vehicle also includes an engine associated with the frame and a power train powered by the engine for driving each of the wheel assemblies, the power train being connected to the differential on each axle. At least one flanged guide wheel is provided for each of the road wheels, each guide wheel being applicable to the rail on which the corresponding road wheel travels and having a flange for contacting the side of the rail to maintain the guide wheel and the corresponding road wheel on the rail. The vehicle is configured for mounting each guide wheel on the frame for movement between a raised position, wherein the guide wheel is lifted off of the rail for movement of the vehicle onto and off of the rails, and a lowered position wherein the guide wheel is applied to the rail.

DETAILED DESCRIPTION

Figure 1:
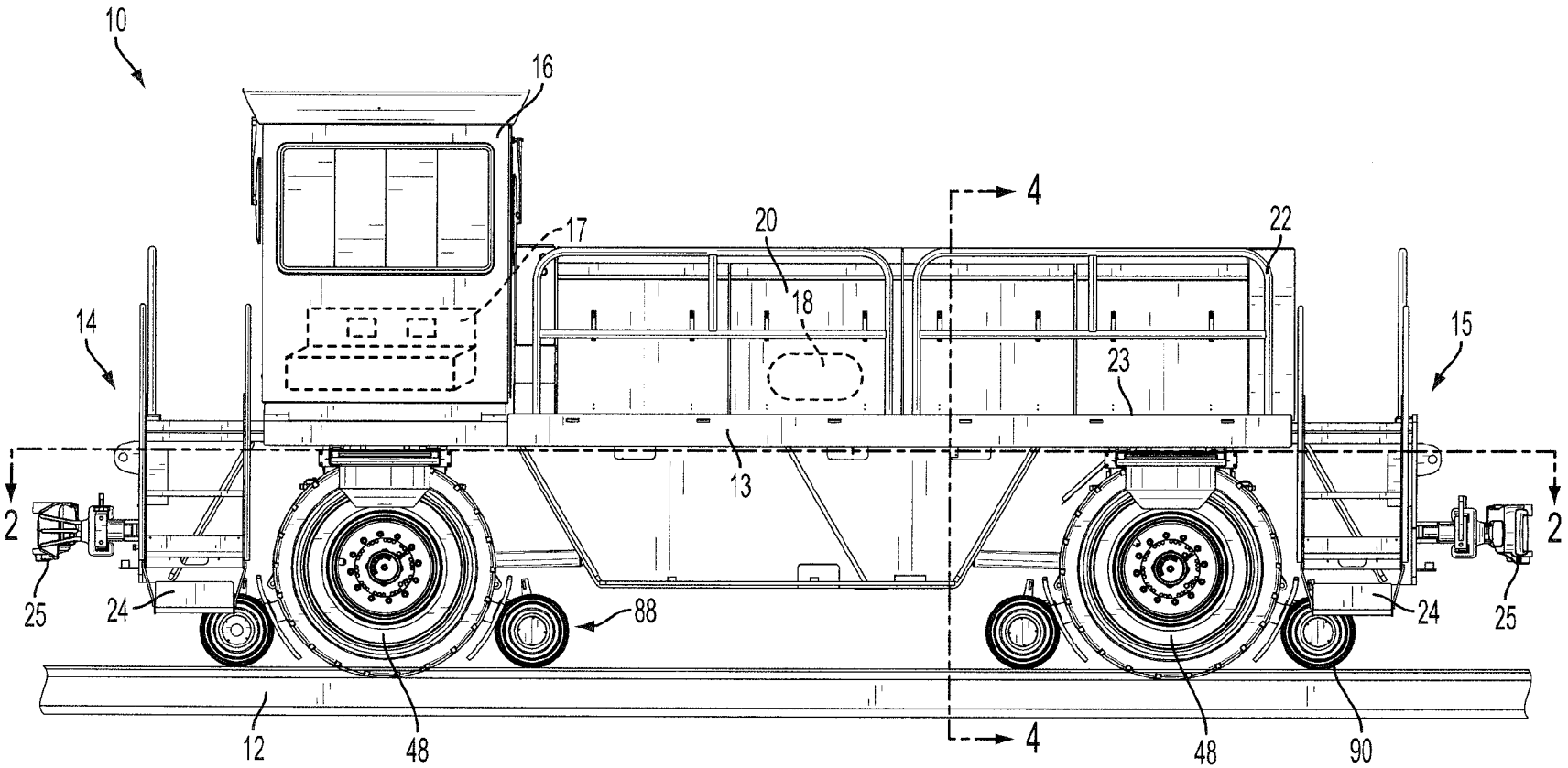
FIG. 1 is a side elevational view of a railway draft vehicle according to the preferred embodiment, with the vehicle travelling along a pair of rails.

Referring now to FIG. 1, a railway draft vehicle constructed in accordance with the present invention is generally designated 10 and is used in railcar sidings and the like to move railcars along conventional railroad track rails 12. The vehicle 10 has a frame 13 with a front end 14 and a rear end 15. A cab 16 is included on the vehicle 10 for accommodating an operator (not shown). A control system 17, shown schematically and hidden, exists for operating the vehicle, preferably inside the cab 16. A conventional internal combustion engine 18 (shown hidden), preferably a diesel engine, is associated with the frame 13 and is covered by a housing 20. Guard rails 22 are provided on an access platform 23 generally extending around a periphery of the housing 20. Front and rear ladders 24 are located near the front end 14 and the opposite rear end 15 for the operator to more easily access the cab 16. Couplers 25 are provided at front and rear ends 14 and 15, respectively, of the vehicle frame 13 for selective coupling with railcars as is well known in the art.

Figure 2:
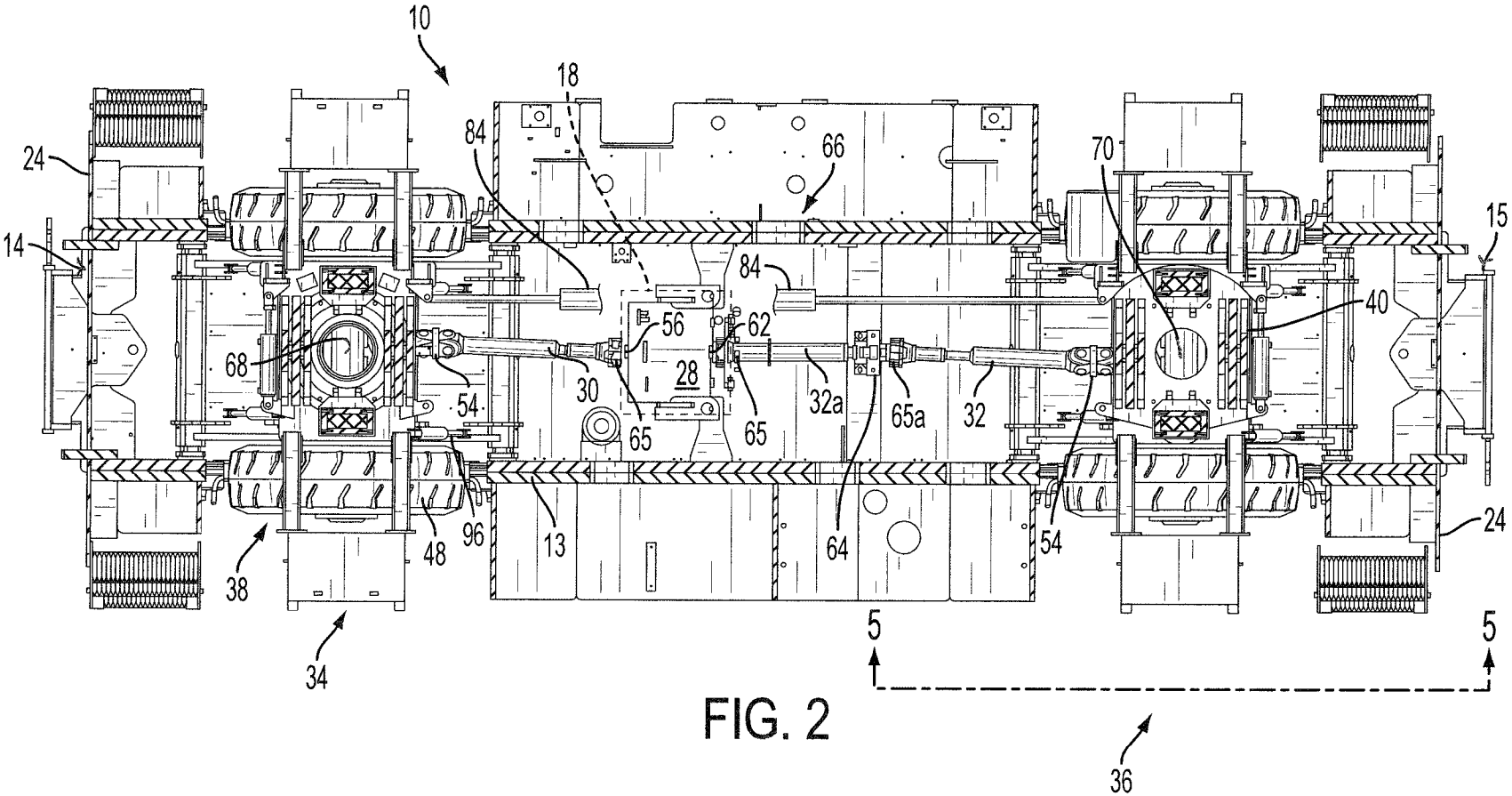
FIG. 2 is a cross-section taken along the line 2-2 in FIG. 1 in the direction generally indicated.
Figure 7:
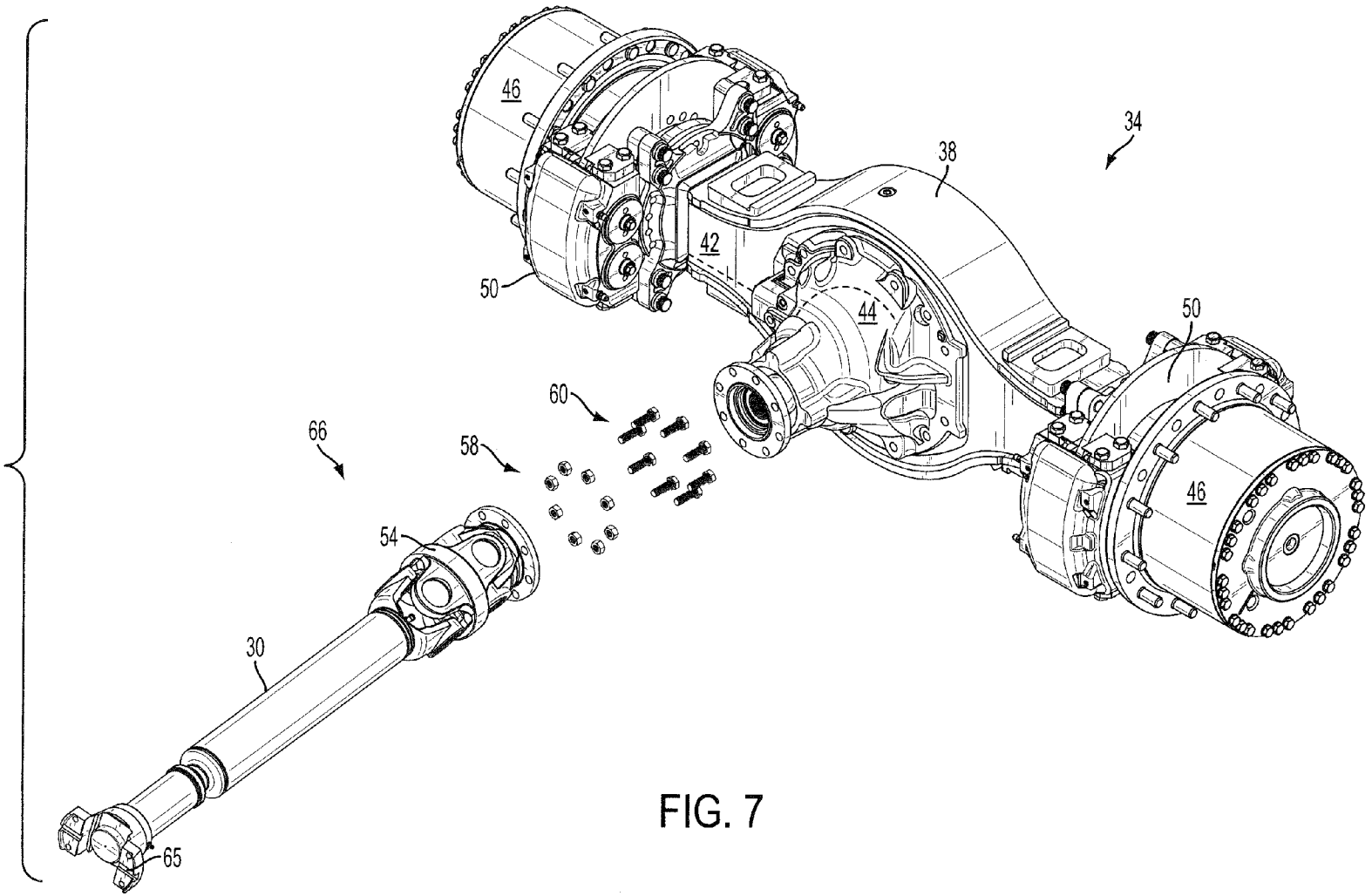
FIG. 7 is an exploded perspective view of the present drive shaft and axle housing.

Referring to FIGS. 1, 2, and 7, as is known in the art, the engine 18 is connected to and powers a transmission 28 (shown schematically), which in turn drives front and rear drive shafts 30 and 32, respectively. In the preferred embodiment, the drive shafts 30, 32 each connect to an output on a corresponding end of the transmission housing. However, other connection schemes are contemplated. The vehicle 10 is equipped with a front wheel assembly 34 and a rear wheel assembly 36, each powered by connections to the respective drive shafts 30, 32.

Referring now to FIG. 7, the front wheel assembly 34 has a front axle housing 38. Similarly, in FIG. 2, the rear wheel assembly 36 has a rear axle housing 40. Because the front and rear axle housings 38, 40 are similar, only the front axle housing 38 will be described in detail. Inside the front axle housing 38 is at least one axle shaft 42 (shown hidden), which is connected to a front differential 44 at one and to a front wheel hub 46 at the other end, as described below. As shown in FIG. 2, each wheel hub 46 carries a road wheel 48 having a tire made of rubber or similar relatively high friction, resilient material, for limiting the amount of slippage of the wheel while riding on the rails. The front differential 44 drives the hubs 46 to which the road wheels 48 are bolted or otherwise secured. The front axle housing 38 also includes brakes 50, shown as disk brakes. However, other types of brakes are contemplated, as known in the art.

In the preferred embodiments, the differential 44 is configured as a limited slip differential or a locking differential so that each pair of wheels 48 will rotate, even if one of the wheels 48 slips. This increases the pulling power of the draft vehicle 10. Thus, a limited slip differential or a locking differential 44 is constructed in a well known manner to prevent either of the road wheels 48 from slipping.

Since the connection between the transmission 28 and the front wheel assembly 34 is similar to the connection between the transmission and the rear wheel assembly 36, only the connection with the front wheel assembly will be discussed. As shown in FIGS. 2 and 7, the front differential 44 connects to a constant velocity joint 54, such as a double cardan joint, which connects to the front drive shaft 30. The constant velocity joint 54 is connected to the front differential 44 with fasteners, preferably threaded fasteners such as nuts 58 and bolts 60. However, other suitable fastening technologies are contemplated.

Referring to FIG. 2, the front drive shaft 30 is connected to a front output 56 of the transmission 28, and the rear drive shaft 32 is connected to a rear output 62 of the transmission 28. Also, a pillow block bearing 64 preferably supports a coupled extension 32*a* of the rear drive shaft 32. The extension 32*a* is directly connected to the transmission 28.

In other words, the front and rear drive shafts 30 and 32, respectively, each connect at one end to the transmission outputs 56 and 62, respectively, using a conventional "U"-joint 65 (FIG. 7), and connect to the respective front and rear differentials 44 at the other end using the constant velocity joint 54. In the case of the rear wheel assembly 36, the rear drive shaft 32 is connected to the extension 32*a* by a U-joint 65*a* near the pillow block bearing 64.

In this manner, the draft vehicle 10 has a power train 66 including the engine 18 powering the transmission 28. The transmission 28 includes the front output 56, which connects via the "U"-joint 65 to the front drive shaft 30, which connects via constant velocity joint 54 to the differential 44 on the front wheel assembly 34. The differential 44 is connected via the axle shaft 42 to the wheel hubs 46 and the road wheel 48. A rear output 62 is also included in the transmission 28 and is connected via the "U"-joint 65 to the rear drive shaft extension 32*a*, which in turn is connected by joint 65*a* to the rear drive shaft 32, which is connected by the constant velocity joint 54 to the differential 44 on the rear wheel assembly 36. The rear differential 44 is connected via an axle shaft 42 to the wheel hubs 46 and the road wheel 48. Thus, the power train 66 transmits power from the engine 18 simultaneously to the road wheels 48 located on both the front and rear wheel assemblies 34 and 36, respectively.

Figure 6:
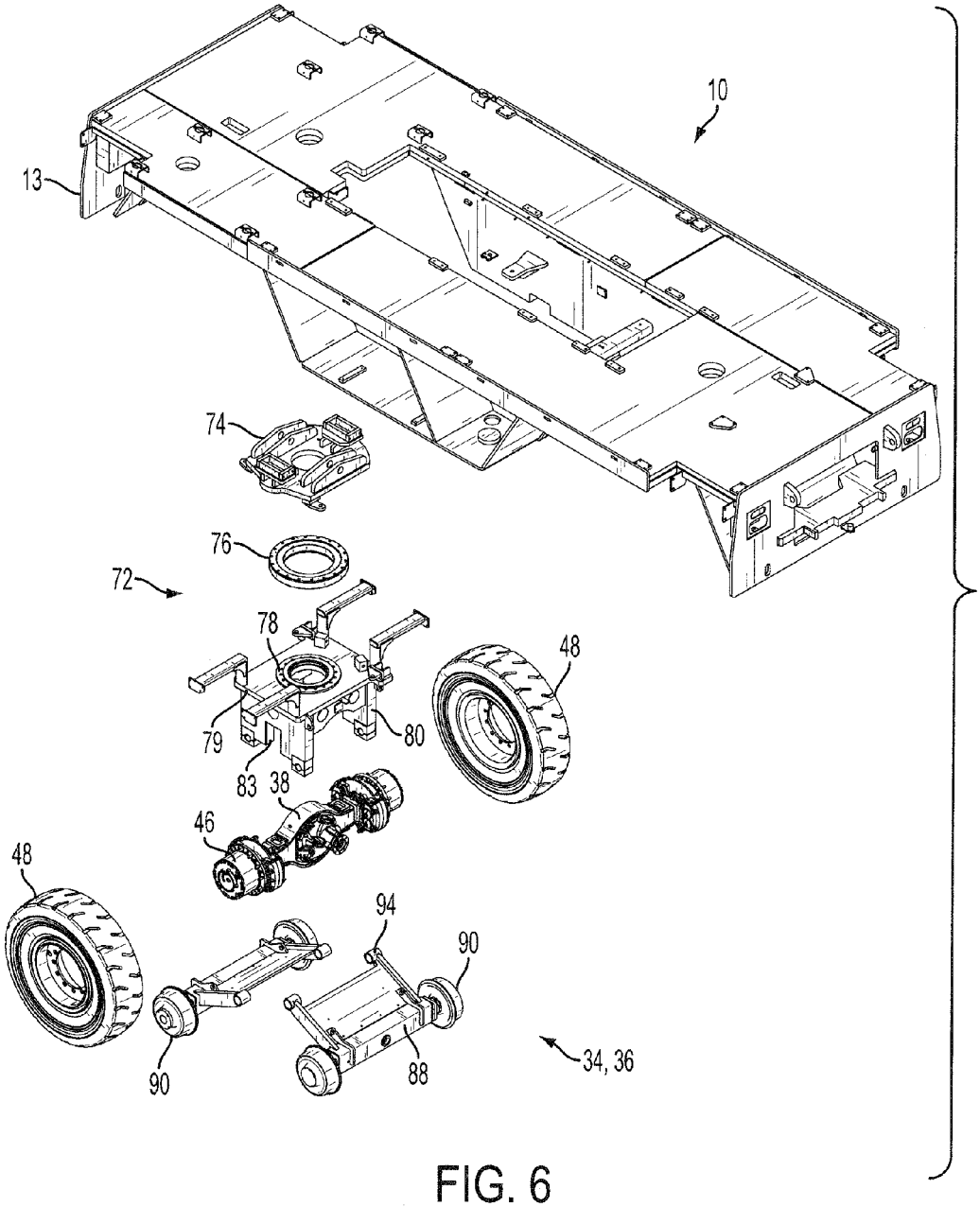
FIG. 6 is an exploded fragmentary perspective view of the present wheel assembly.

As best seen in FIGS. 2 and 6, the front and rear axle housings, 38 and 40 respectively, are mounted to the frame 13 of the vehicle 10 such that they turn about vertical axes 68 and 70, respectively. Each axis 68, 70 is centered on a corresponding bearing assembly 72, and which in turn is preferably centered on the axle housings 38 and 40. The bearing assembly 72 includes a bearing mount 74 connected to the underside of the frame 13. Also included in the bearing assembly 72 is an inner race 76, which is rotatable relative to an outer race 78, located on an axle mount 79 associated with each wheel assembly 34, 36.

Figure 4:
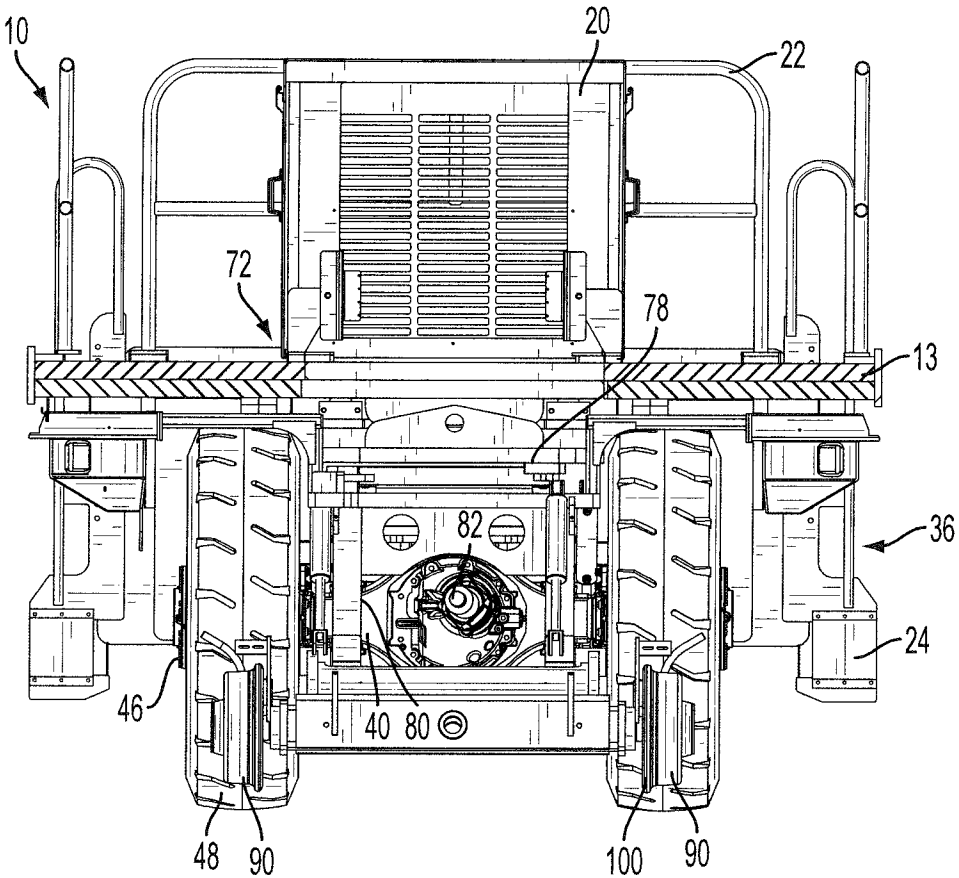
FIG. 4 is a cross-section taken along the line 4-4 in FIG. 1 in the direction generally indicated.

As best shown in FIG. 4, each wheel assembly 34 and 36 is connected to the respective bearing assembly 72 by a trunnion mount 80 formed by a lower portion of the axle mount 79. Since there are two such mounts 80 on the vehicle 10, only the trunnion mount on the rear wheel assembly 36 will be described. The trunnion mount 80 allows the rear wheel assembly 36 to rotate about a substantially horizontal pivot axis 82 for accommodating uneven track conditions between the two rails 12. More specifically a slot 83 in each side of the mount 80 accommodates upward movement of the corresponding side of the wheel assembly 34 and the wheel 48. In the preferred embodiment, the trunnion mount 80 is centered on the axle housing 40.

Figure 3:
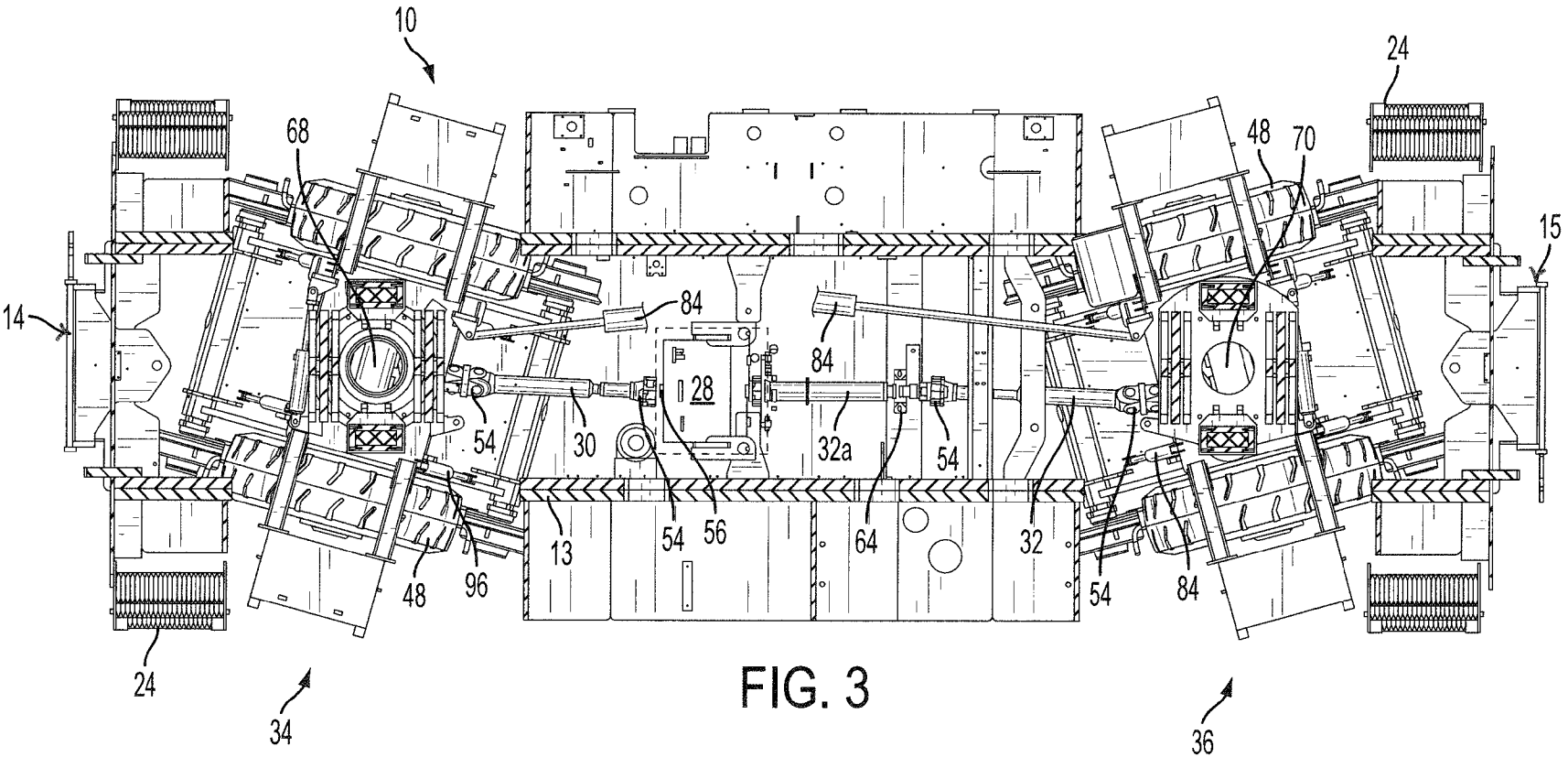
FIG. 3 is a cross-section similar to FIG. 2, but showing the wheel assemblies turned.

Referring now to FIGS. 2 and 3, an important feature of the present power train 66 on the vehicle 10 is that a driving engagement is maintained between the transmission 28 and the respective wheel assemblies 34 and 36 through-out the range of movement of the wheel assemblies through steering of the vehicle. During the steering operation, the wheel assemblies 34 and 36 pivot about their respective vertical axes 68, 70. The use of the constant velocity joints 54 on each of the drive shafts 30, 32 preserves this driving engagement and accommodates the lateral movement of the wheel assemblies 34, 36, as seen especially in FIG. 3.

Referring to FIGS. 2 and 3, the operator of the vehicle 10 uses the control system 17 to turn both wheel assemblies 34 and 36. This is achieved by selectively pressurizing a pair of hydraulic steering cylinders 84. At least one hydraulic steering cylinder 84 is connected to the frame 13 at one end, and at the other end to each wheel assembly 34 and 36. Since steering is similar for the front and rear wheel assemblies 34, 36, only the interaction between the hydraulic cylinder 84 and the front wheel assembly 34 will be described.

In the preferred embodiment, a rod end of the cylinder 84 pivotally connects with the front wheel assembly 34 at a location offset from the turning axis 68. The opposite or blind end of the cylinder 84 is pivotally attached to a different part of the draft vehicle 10, such as the frame 13 (fragmented connection shown). When the cylinder 84 is retracted from the position shown in FIG. 2 through suitable manipulation of the control system 17 by the operator, the wheel assembly 34 is pivoted about the vertical axis 68. The control system 17 can also be disengaged when the vehicle 10 travels along the tracks 12, as discussed later. Extension of the rod of the cylinder from the position of FIG. 2 causes the wheel assembly 34 to turn in the opposite direction.

The operator operates the control system 17 to rotate the front and rear wheel assemblies 34, 36 in the same direction or the opposite direction. In other words, the control system 17 allows for independent control of the steering of the wheel assemblies 34, 36.

In addition, the control system 17 also has a "freewheeling" mode of operation in which fluid pressure is not applied to either end of the cylinder 84, and the wheel assemblies 34, 36 are then not steered at all but are instead able to "freewheel" about the vertical axes 68, 70. Freewheeling mode is typically be used when the draft vehicle travels on the rails. The control system 17 allows the operator of the vehicle 10 to switch back and forth from steering to freewheeling modes.

Figure 5:
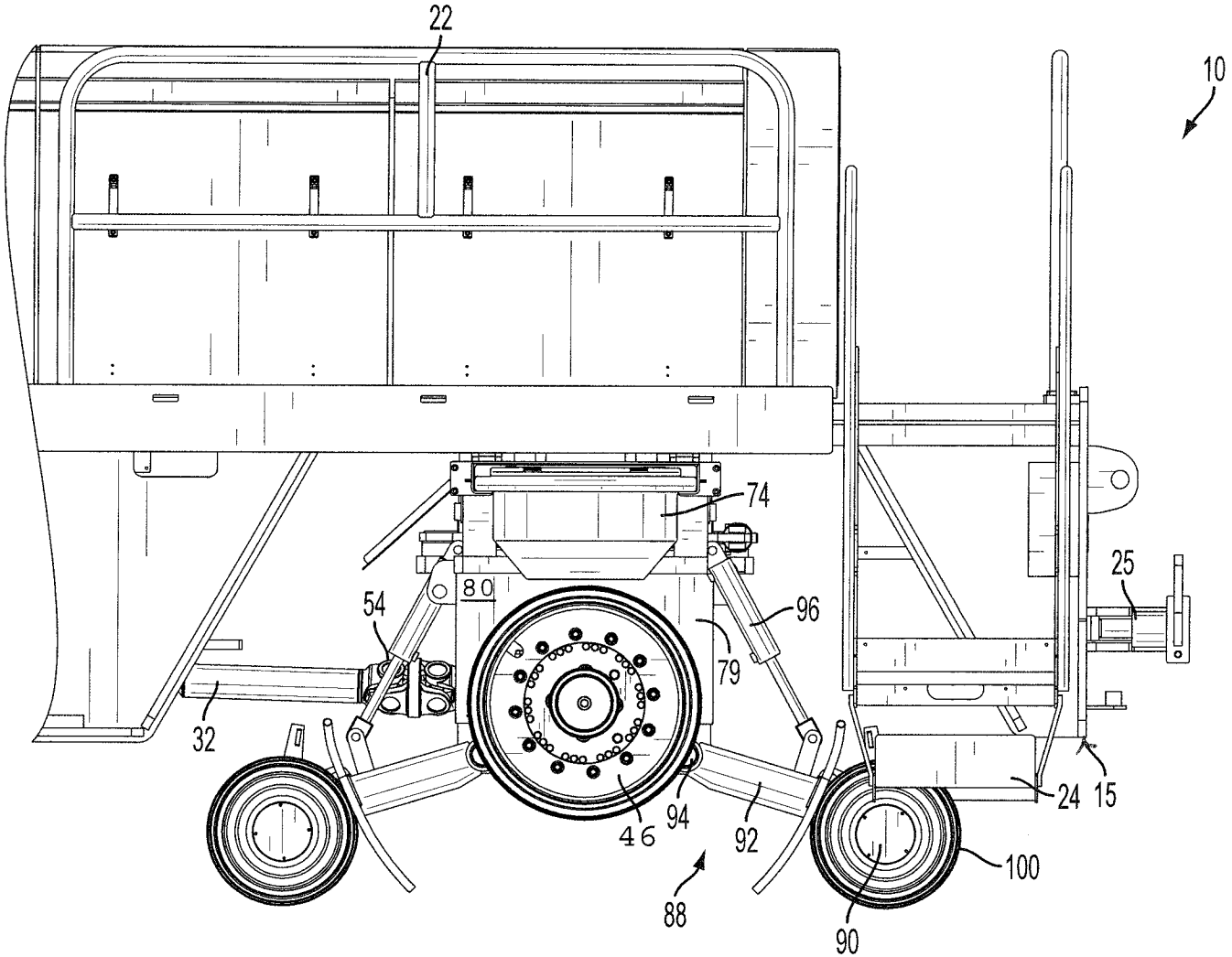
FIG. 5 is a fragmentary side elevation view of the present wheel assembly taken along the line 5-5 in FIG. 2 in the direction generally indicated.

Referring to FIG. 5, a guide wheel bracket assembly 88 will now be described for the rear wheel assembly 36. However, a similar guide wheel bracket assembly 88 is also used on the front wheel assembly 34. Each of the road wheels 48 of the vehicle 10 includes the guide wheel bracket assembly 88. At least one flanged guide wheel 90 is associated with the bracket assembly 88. Each guide wheel 90 is smaller than the road wheel 48, and is preferably constructed of steel. Also, the bracket assembly 88 is preferably configured for movement between a raised position where the guide wheel 90 is lifted from the rails 12 so that the vehicle 10 can move onto and off of the rails, and a lowered position where the guide wheel 90 engages the rails 12. In addition, the movement between the raised and lowered positions of the bracket assembly 88 is achieved by using a power source (not shown) typically hydraulic motors driven ultimately by the engine 18, as is well known in the art.

Each guide wheel 90 is carried on the outer end of a pivot arm 92 which is connected at its opposite end with the corresponding wheel assembly (rear assembly 36 shown) by a pivot coupling 94. The pivot coupling 94 provides a horizontal axis about which the guide wheels 90 lower onto the rails or raised off of the rails 12. As each guide wheel 90 is raised or lowered, its pivot arm 92 is pivoted upwardly or downwardly about the corresponding pivot coupling 94.

Raising and lowering of each guide wheel 90 is carried out by a hydraulic cylinder 96. The rod end of each cylinder 96 is pivotally connected to the bracket assembly 88. The opposite or blind end of each cylinder 96 is pivotally connected with the rear wheel assembly 36. Each of the cylinders 96 extends to lower the bracket assembly 88 onto the rail 12 or retracts to raise the assembly above the tracks 12. The control system 17 controls the operation of the cylinders 96. Normally, the guide wheels 90 are held downwardly only with enough force to keep them firmly on the rails 12, and the entire weight of the vehicle 10 is then borne by the road wheel 48. However, it is possible to increase the downward force to break through debris, such as snow or ice.

As seen in FIG. 4, each of the guide wheels 90 has a peripheral flange 100, which projects beyond the main body of the guide wheel 90. When the guide wheel 90 is riding on the top of the rail 12, the flange 100 is disposed in contact with the side of the top bead of the rail. In this manner, the guide wheels 90 provide guiding action to maintain the guide wheels 90 the road wheels 48, and the vehicle 10 on the rails 12. When the flanges 100 of the guide wheel are disposed against the rails 12, the road wheels 48 are centered on the rails to avoid undue wear on the edge portions of the road wheels, as shown in FIG. 4.

As shown in FIG. 5, the guide wheels 90 are preferably provided in pairs, with one pair of guide wheels 90 associated with each road wheel 48. One of the guide wheels 90 in each pair is preferably located in a leading position relative to the associated wheel 48, while the other guide wheel 90 is located in a trailing position relative to the wheel 48. This arrangement and location of the guide wheels 90 is especially effective in maintaining the road wheels 48 centered on the rails 12, particularly when relatively sharp curves are being negotiated. However, it is possible to utilize only one guide wheel for each traction wheel and still achieve beneficial results.

In operation of the draft vehicle 10, the guide wheels 90 are raised when the vehicle 10 is being driven over a roadway, over the ground, or anywhere other than along the rails 12. When the vehicle 10 is being driven anywhere other than along the rails 12, the steering system is in the steering mode, and the operator can steer the vehicle 10 as desired by controlling the steering cylinder 84 appropriately.

In operation, the vehicle drives onto the rails 12 and then pulls rail cars along the rails. A "crab type" entry of the vehicle 10 onto the rails 12 is carried out by first stationing the vehicle beside the rails, and then turning both wheel assemblies 34, 36 to an extreme position to orient the road wheels 48 toward the rails 12 before driving the vehicle 10 forwardly until all of the road wheels 48 are on the rails. The steering cylinder 84 straightens the road wheels 48 until they are centered on the rails in the position shown in FIG. 2. Then, the hydraulic cylinder 96 extend to lower the guide wheels 90 onto the rail 12 with the flanges 100 contacting the inside edges of the beads of the rails.

When the vehicle 10 is moved along the rails 12, it is normally in the freewheeling mode. The contact of the flanges 100 against the rails 12 provides a guiding action which accurately steers the vehicle 10 along the rails and at the same time maintains all of the road wheels 48 in centered positions on the rails to avoid undue wear on the edge portions of the road wheels. When the vehicle 10 encounters a curve, the flanges 100 of the guide wheels 90 follow the curves of the rails 12 and automatically turn the wheel assemblies 34 and 36 in a manner to enable the road wheels 48 to follow the curve and remain centered on the rails. Consequently, the operator need not steer the vehicle along the rails 12 and the traction road wheels 48 automatically remain centered on the rails without operator involvement. Because all four road wheels 48 are driven wheels and the differentials 44 are limited slip differentials, all four road wheels 48 provide motive power at all times and to prevent wheel slippage.

The draft vehicle 10 is driven off of the rails 12 by placing the steering system in steering mode, raising the guide wheel assembly 88, and turning the wheel assemblies 34 and 36 before driving the vehicle 10 off of the rails 12.

While a particular embodiment of the present rail draft vehicle has been described herein, it will be appreciated by those skilled in the art that changes and modifications may be made thereto without departing from the invention in its broader aspects and as set forth in the following claims.

The invention claimed is:

1. A rail draft vehicle for moving railcars along a pair of rails, the vehicle comprising:

a frame having a front end and a rear end;

a front wheel assembly associated with said front end of said frame and a rear wheel assembly associated with said rear end of said frame, each wheel assembly including a fixed axle housing and a pair of road wheels connected for rotation relative to said axle housing, and each wheel assembly pivoting as a unit relative to said frame about a vertical axis such that steering of said vehicle is achieved by said pivoting action of said wheel assemblies relative to said frame;

an engine associated with said frame;

a power train powered by said engine for driving each of said wheel assemblies, said power train connected to each said axle; and at least one guide wheel associated with at least one of said front and rear wheels for aligning said wheels on the rails, each guide wheel traveling on the rail and having a flange for contacting the side of the rail.

2. The rail draft vehicle of claim 1, wherein said axle housing includes at least one axle shaft.

3. The rail draft vehicle of claim 1, wherein said power train further comprises at least one constant velocity joint connected to each said wheel assembly.

4. The rail draft vehicle of claim 1, further comprising at least one drive shaft for each wheel assembly, wherein each of said drive shafts maintains a driving engagement between said engine and said wheel assemblies as said wheel assemblies rotate about said vertical axes.

5. The rail draft vehicle of claim 1, wherein said at least one guide wheel further comprises at least one flanged guide wheel for each of said road wheels, each said guide wheel being applicable to the rail on which said corresponding road wheel travels, and having a flange for contacting a side of the rail to maintain said guide wheel and said corresponding road wheel on the rail during movement of said vehicle on the rails.

6. The rail draft vehicle of claim 5, further comprising a mounting bracket assembly for at least one said guide wheel on said frame and configured for movement between a raised position wherein said guide wheel is lifted from the rail for movement of said vehicle onto and off of the rails, and a lowered position wherein said guide wheel engages the rail.

7. The rail draft vehicle of claim 6, further comprising a power source for effecting movement of said guide wheel between said raised and said lowered positions.

8. The rail draft vehicle of claim 1, further comprising a differential on each said wheel assembly, each differential being one of a limited slip differential and a locking differential.

9. The rail draft vehicle of claim 1, further comprising a trunnion mount for at least one of said wheel assemblies to pivot about a substantially horizontal pivot axis.

10. The rail draft vehicle of claim 1, further comprising a steering system including a front hydraulic steering cylinder associated with said frame at one end and said front wheel assembly at said other end, wherein selective pressurization of said front steering cylinder causes rotation of said front wheel assembly about said vertical axis.

11. The rail draft vehicle of claim 10, further comprising:

a rear hydraulic steering cylinder attached to said frame at one end and attached to said rear wheel assembly at said other end, wherein selective pressurization of said rear steering cylinder causes rotation of said rear wheel assembly about said vertical axis.

12. The rail draft vehicle of claim 11, wherein the steering system is disengageable when the draft vehicle travels along the rails.

13. A rail draft vehicle for moving railcars along a pair of rails, comprising:

a transmission;

a front drive shaft connected to said transmission at one end and connected by a front constant velocity joint to a front differential at the other end, said front differential driving a pair of front wheels connected to a common axle, said axle being pivotable relative to a frame of the vehicle about a vertical axis;

a rear drive shaft connected to said transmission at one end and connected by a rear constant velocity joint to a rear differential at the other end, said rear differential driving a pair of rear wheels; and at least one guide wheel associated with at least one of said front wheels and said rear wheels for aligning said wheels on the rails, each guide wheel traveling on the rail and having a flange for contacting the side of the rail.

14. The rail draft vehicle of claim 13, wherein at least one of said front differential and said rear differential is one of a limited slip differential and a locking differential.

15. The rail draft vehicle of claim 13, further comprising at least one of said front constant velocity joint and said rear constant velocity joint is a double cardan joint.

16. The rail draft vehicle of claim 13, wherein at least one of said front constant velocity joint and rear constant velocity joint is located between at least one of said front drive shaft and front differential and said rear drive shaft and rear differential.

17. The rail draft vehicle of claim 13, further comprising at least one pillow block bearing supporting at least one of said front drive shaft and rear drive shaft.

18. The rail draft vehicle of claim 13, further comprising a mounting bracket assembly for at least one said guide wheel and configured for movement between a raised position wherein said guide wheel is lifted from the rail for movement of said vehicle onto and off of the rails, and a lowered position wherein said guide wheel engages the rail.

19. A rail draft vehicle for moving railcars along a pair of rails, comprising:

a frame having a front end and a rear end;

a front wheel assembly associated with said front end of said frame and a rear wheel assembly associated with said rear end of said frame, each wheel assembly having a differential and a pair of road wheels joined by an axle and each said wheel assembly pivoting as a unit relative to said frame about a vertical axis;

an engine associated with said frame; and a power train powered by said engine for driving each of said wheel assemblies, said power train connected to the differential on each axle;

at least one flanged guide wheel for each of the road wheels, each guide wheel being applicable to the rail on which the corresponding road wheel travels and having a flange for contacting the side of the rail to maintain the guide wheel and the corresponding road wheel on the rail; and a mount for each guide wheel on the frame for movement between a raised position wherein the guide wheel is lifted off of the rail for movement of the vehicle onto and off of the rails and a lowered position wherein the guide wheel is applied to the rail.

* * * * *